US007552900B2

(12) United States Patent
Yoon

(10) Patent No.: US 7,552,900 B2
(45) Date of Patent: Jun. 30, 2009

(54) APPARATUS FOR REGULATING HEIGHT OF MUSIC RACK

(76) Inventor: Kuk-Won Yoon, Hodong APT 104, 254-12, Junggok-dong, Gwangjin-gu, Seoul (KR) 143-904

( * ) Notice: Subject to any disclaimer, the term of this patent is extended or adjusted under 35 U.S.C. 154(b) by 313 days.

(21) Appl. No.: 11/571,004

(22) PCT Filed: Jun. 28, 2005

(86) PCT No.: PCT/KR2005/002024

§ 371 (c)(1),
(2), (4) Date: Dec. 20, 2006

(87) PCT Pub. No.: WO2006/034128

PCT Pub. Date: Mar. 30, 2006

(65) Prior Publication Data

US 2008/0078734 A1 Apr. 3, 2008

(30) Foreign Application Priority Data

Jul. 1, 2004 (KR) ..... 10-2004-0051116

(51) Int. Cl.
*F16M 11/00* (2006.01)

(52) U.S. Cl. ..... 248/412; 248/157; 248/408

(58) Field of Classification Search ..... 248/408, 248/414, 125.8, 157, 616, 411, 412, 333; 108/147, 144.11, 146, 147.19; 211/196, 211/205; 297/338, 339, 344.18; 84/421, 84/327, 486

See application file for complete search history.

(56) References Cited

U.S. PATENT DOCUMENTS 1,103,839 A * 7/1914 Rellay ..... 248/412
1,772,240 A * 8/1930 Burk ..... 248/412
1,859,223 A * 5/1932 Stevenson ..... 248/412
2,171,653 A * 9/1939 Heitmann ..... 248/409
2,224,527 A * 12/1940 Strobel ..... 248/412
2,488,480 A * 11/1949 Spirt ..... 403/112
3,004,743 A * 10/1961 Wenger ..... 248/161
3,807,574 A * 4/1974 Lanza ..... 211/207
3,853,297 A * 12/1974 Drolet ..... 248/412
4,650,145 A * 3/1987 Natzel et al. ..... 248/414
5,570,968 A * 11/1996 Sassmannshausen et al. ..... 403/109.3
6,213,434 B1 * 4/2001 Reichanadter, Jr. ..... 248/125.8
6,590,148 B1 7/2003 Medina
6,609,686 B2 * 8/2003 Malizia ..... 248/125.8

(Continued)

FOREIGN PATENT DOCUMENTS

JP 2002-328675 A 11/2002

(Continued)

OTHER PUBLICATIONS

English Language Abstract of KR 2002-328675.

(Continued)

*Primary Examiner*—Gwendolyn Baxter
(74) *Attorney, Agent, or Firm*—Greenblum & Bernstein, P.L.C.

(57) ABSTRACT

Disclosed is an apparatus for regulating a height of a music rack capable of improving convenience and operability of a use by allowing a strut length of the music rack to be regulated conveniently and easily while simplifying its structure to improve manufacturability and assemblability.

5 Claims, 10 Drawing Sheets

U.S. PATENT DOCUMENTS 7,204,466 B2 * 4/2007 Hsieh ..... 248/410

FOREIGN PATENT DOCUMENTS

| | | |
|---|---|---|
| KR | 2002-328675 | 11/2002 |
| KR | 20-0320057 | 7/2003 |
| KR | 320057 | 7/2003 |
| KR | 200320057 | 7/2003 |
| KR | 20-20030022835 | 10/2003 |
| KR | 329058 | 10/2003 |

OTHER PUBLICATIONS

English language Abstract of JP 2002-328675 A, Nov. 15, 2002.

* cited by examiner

[Fig. 1]
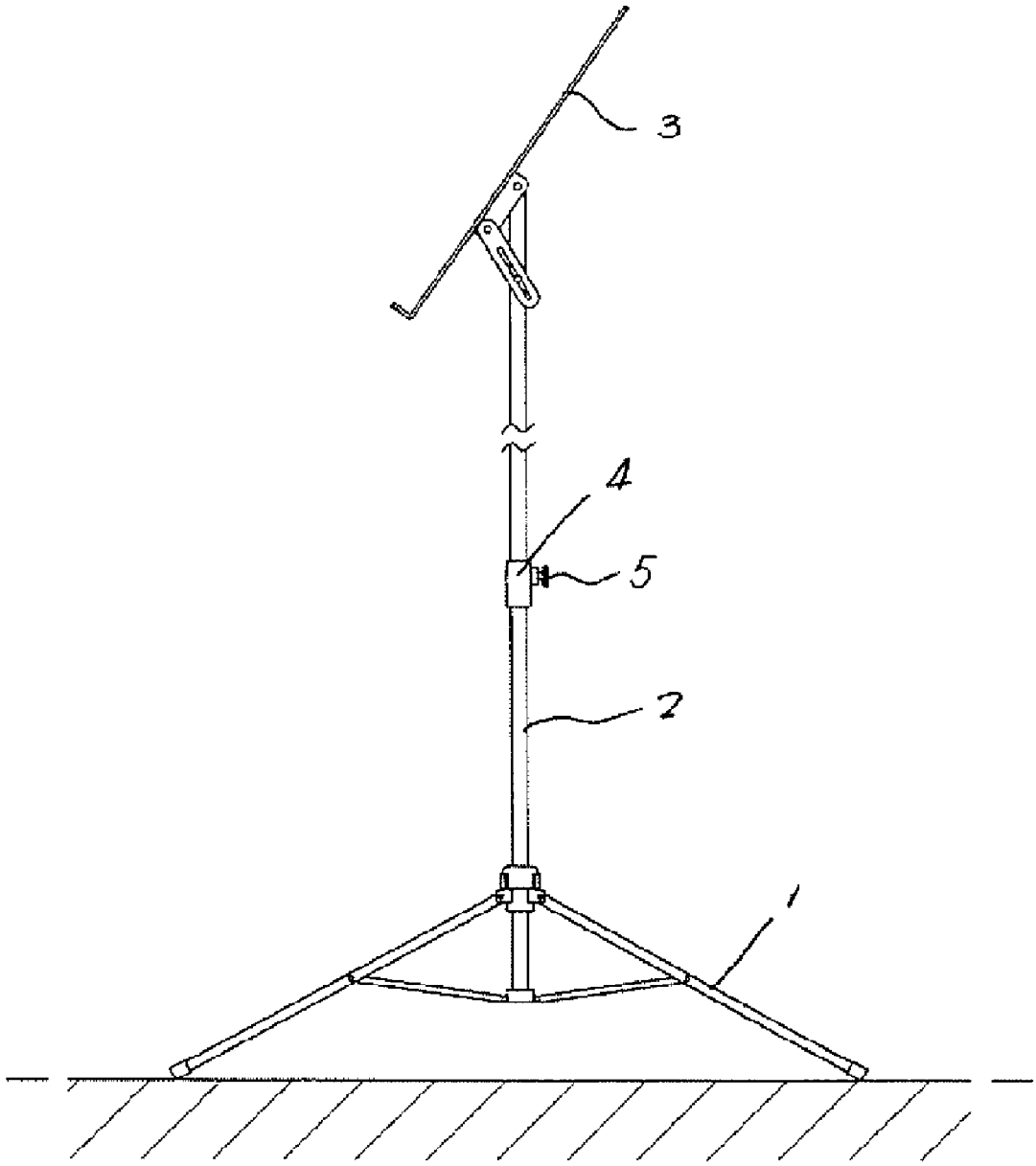

[Fig. 2]
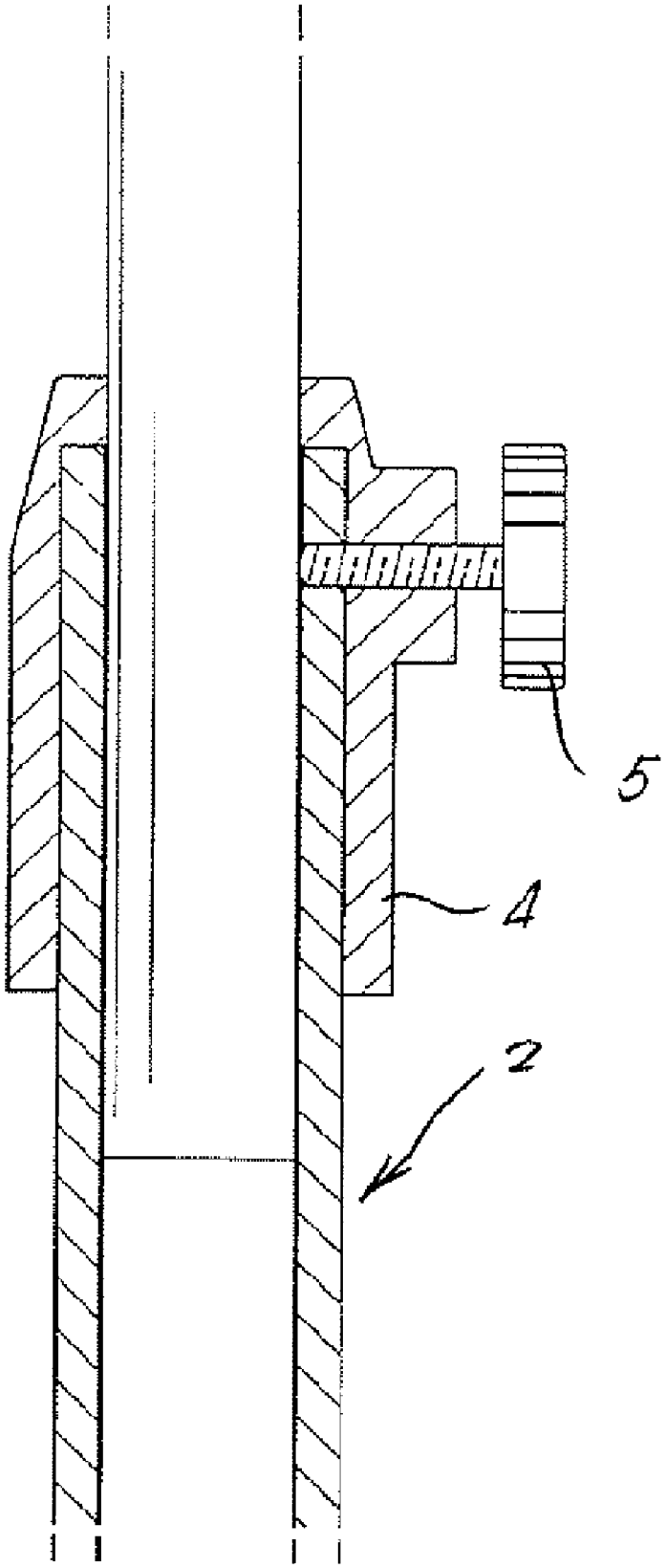

[Fig. 3]
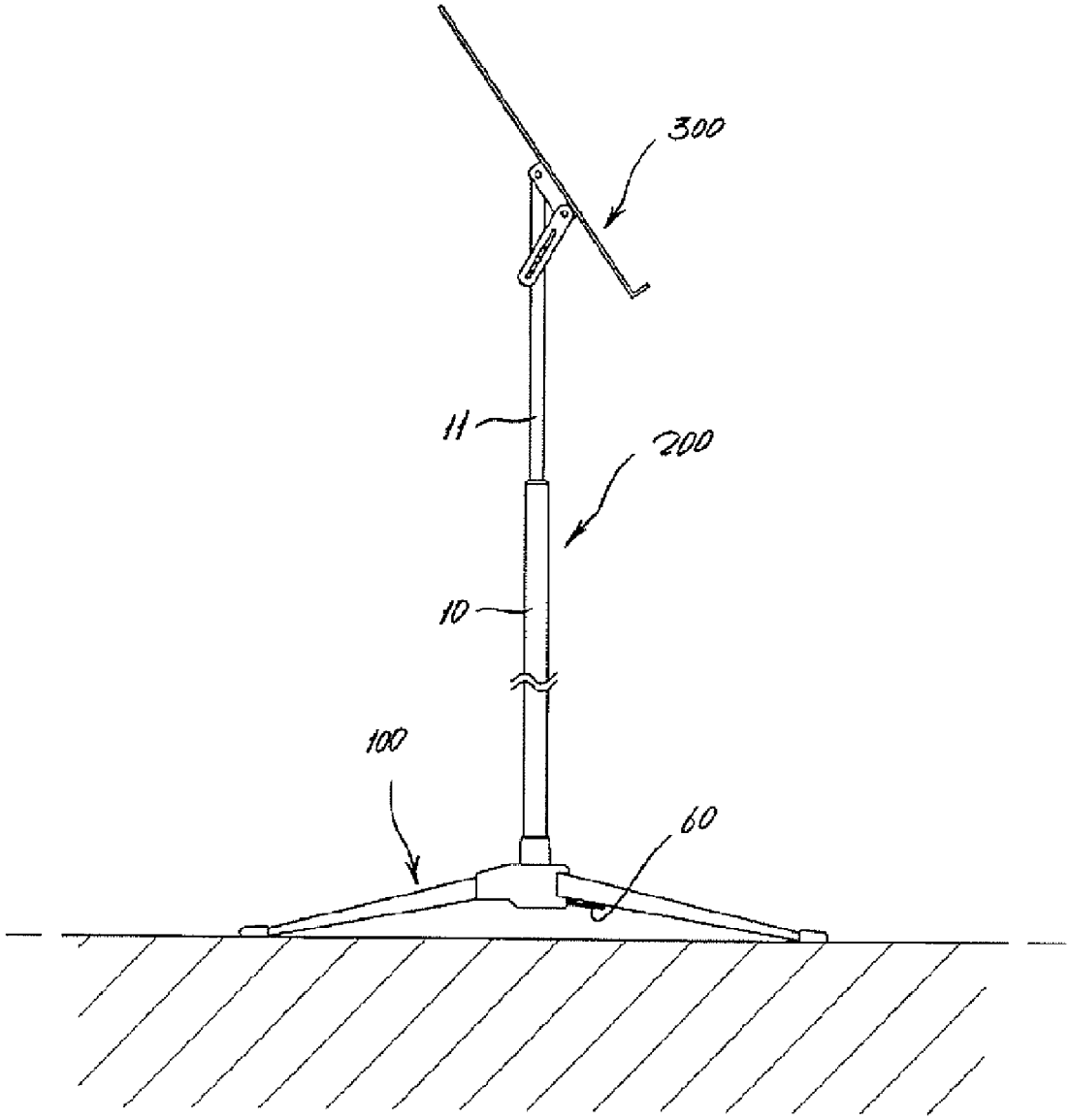

[Fig. 4]
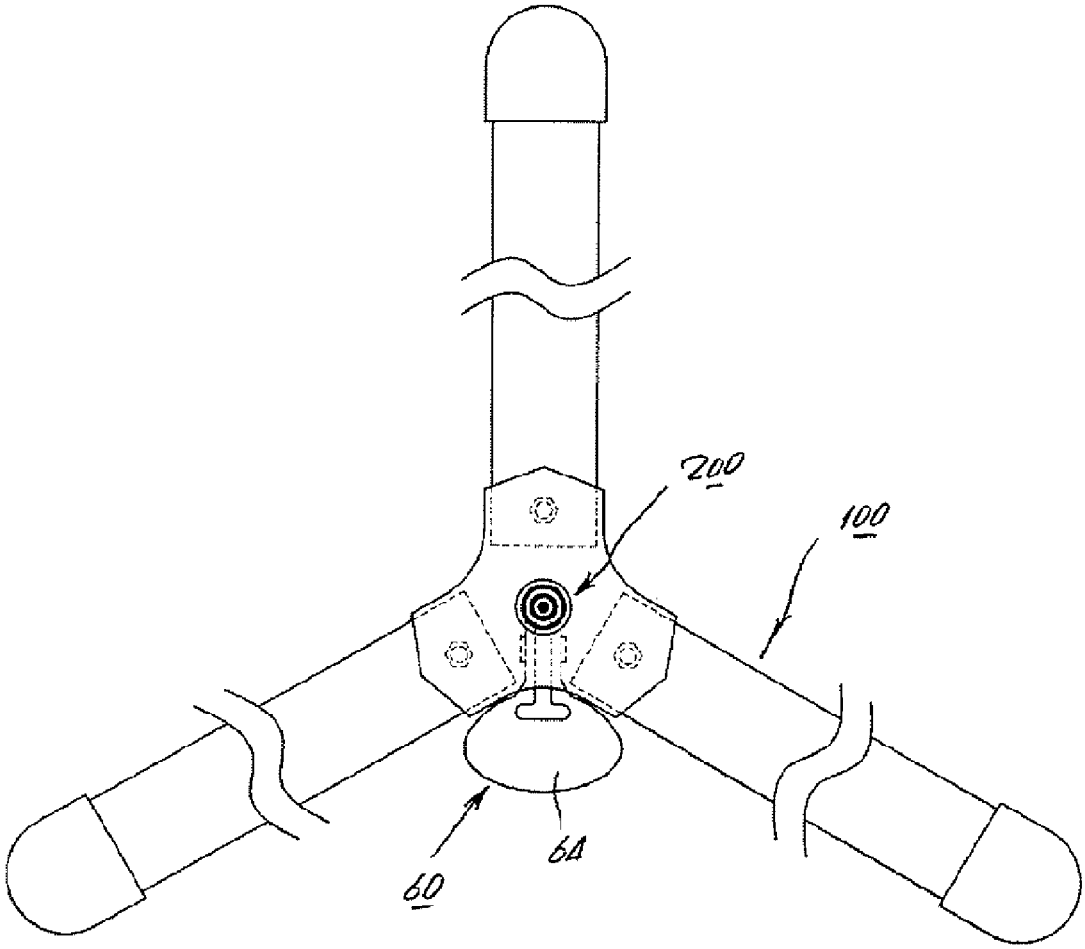

[Fig. 5]
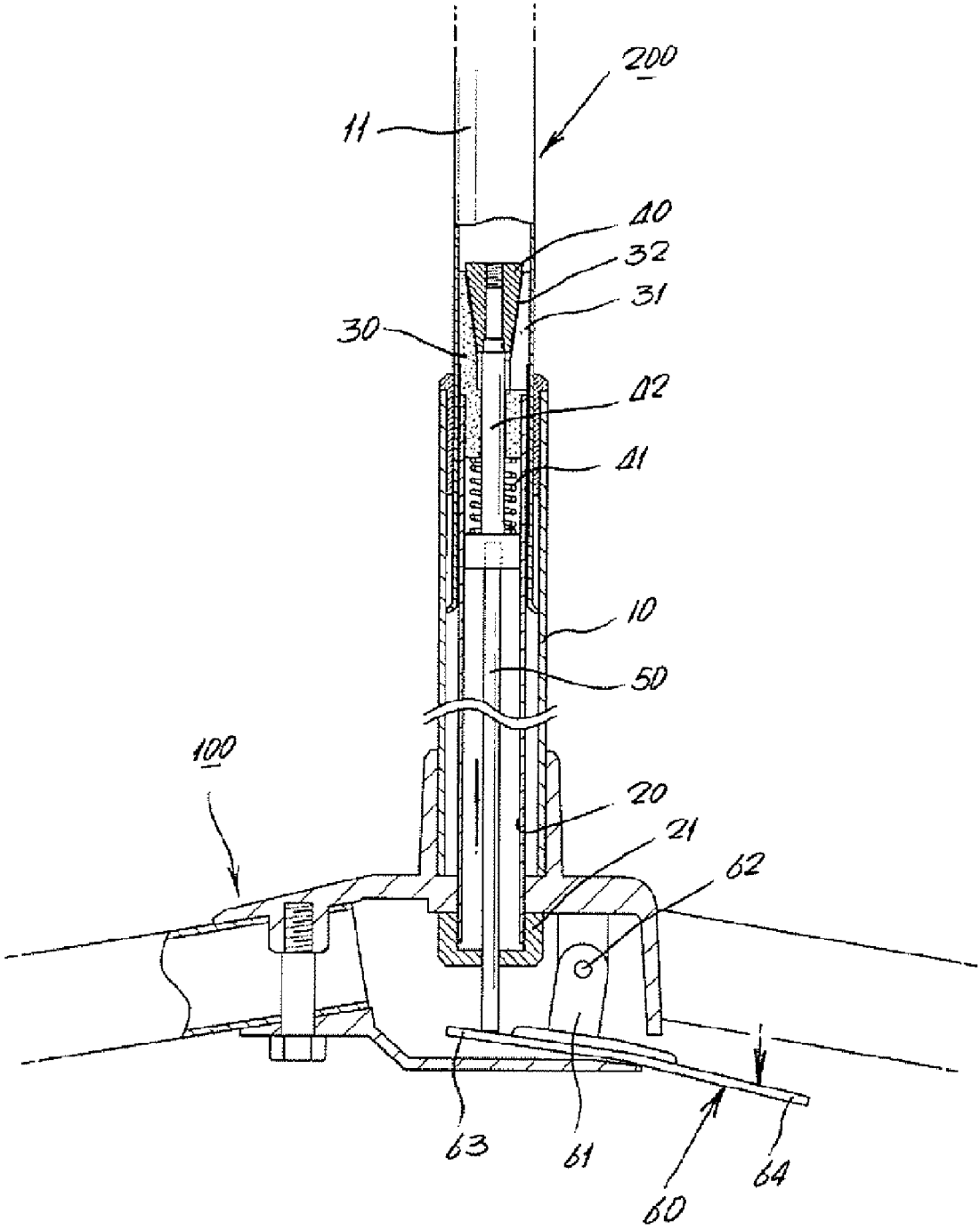

[Fig. 6]
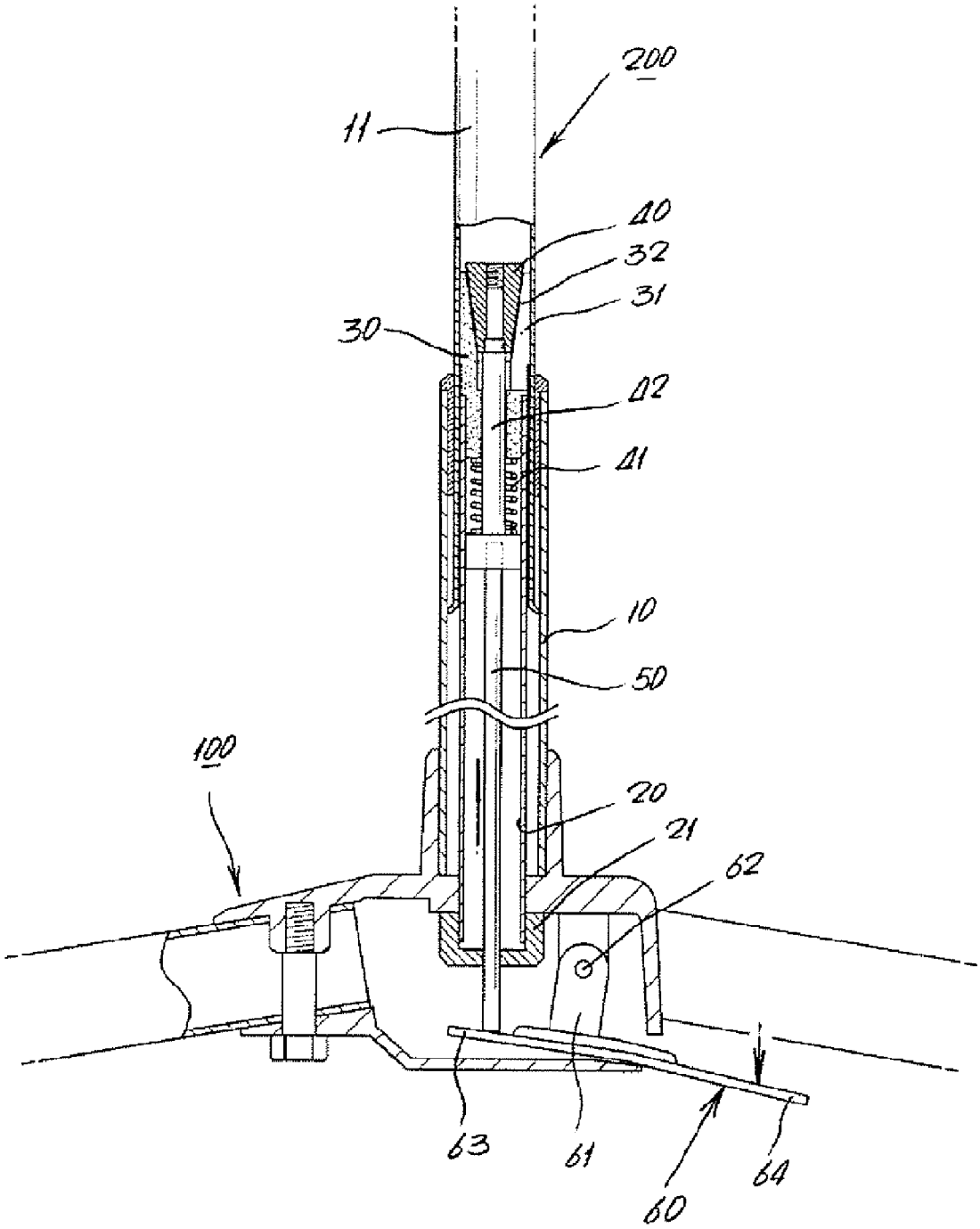

[Fig. 7]
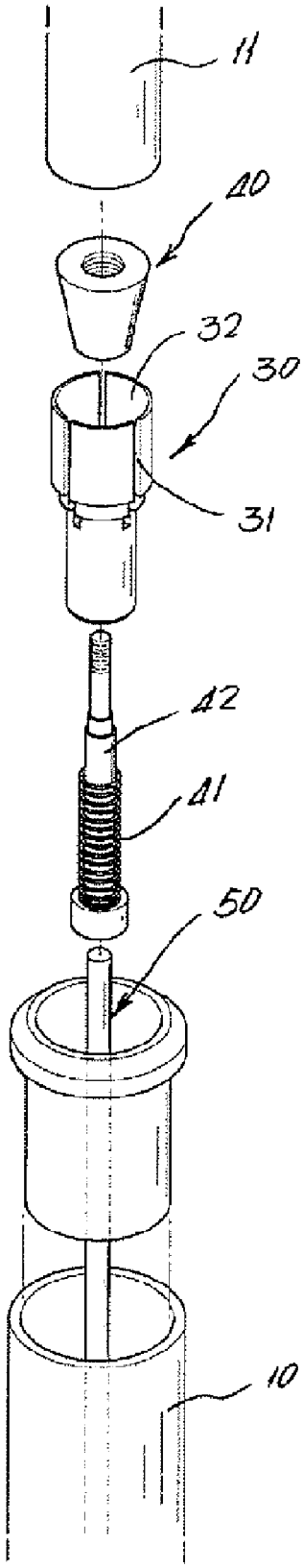

[Fig. 8]
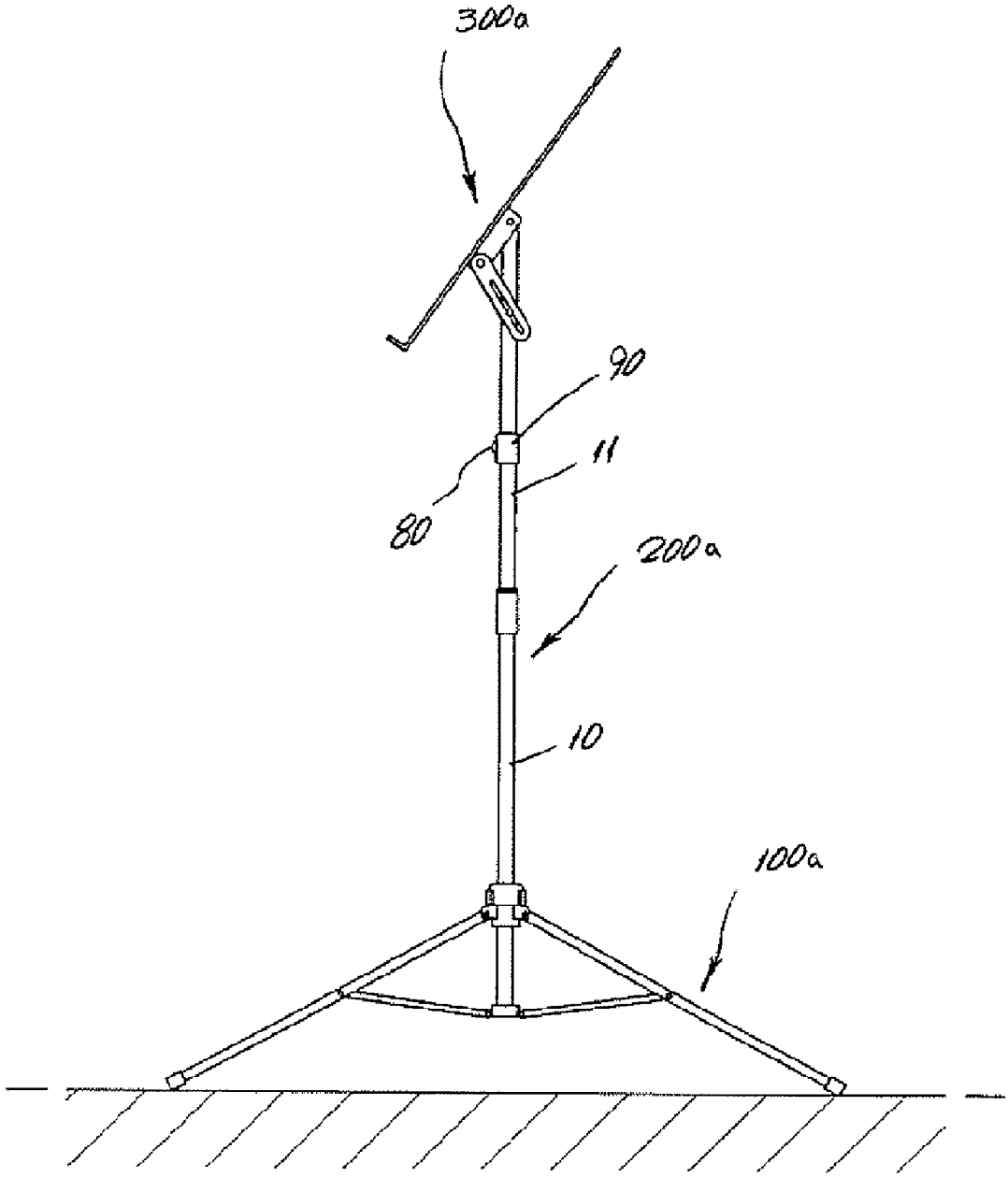

[Fig. 9]
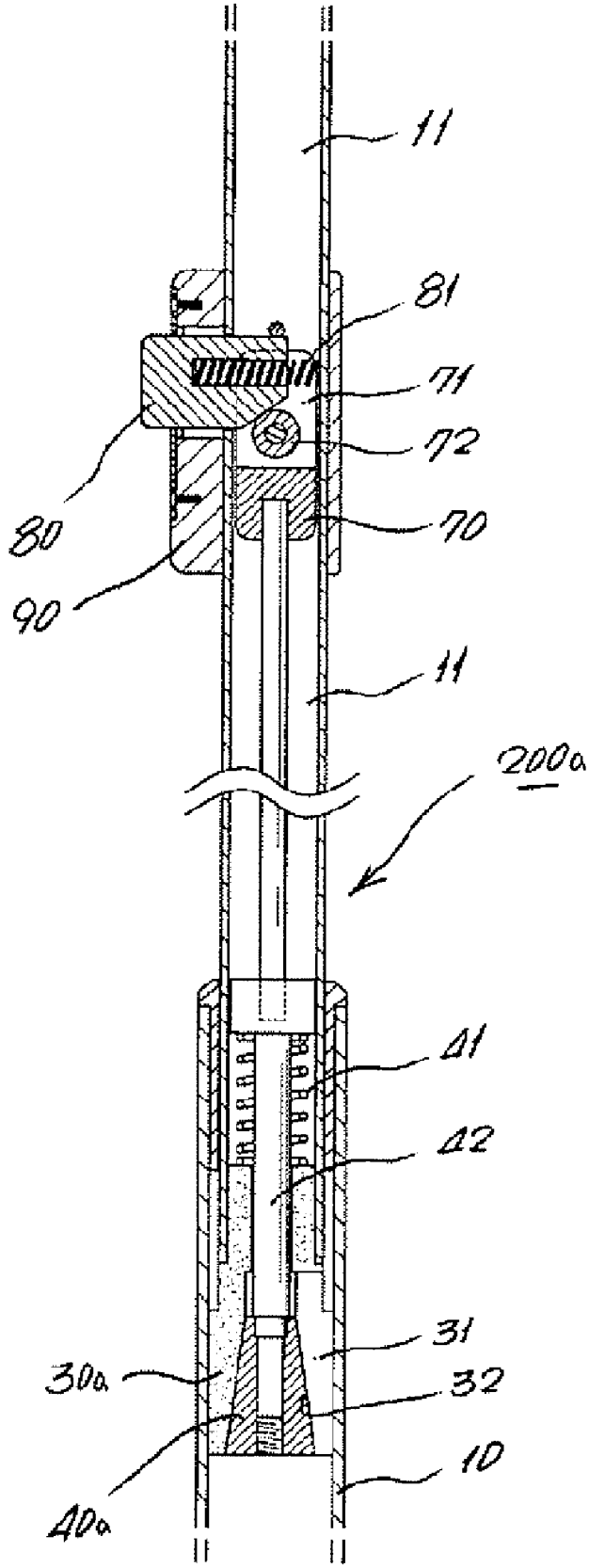

[Fig. 10]
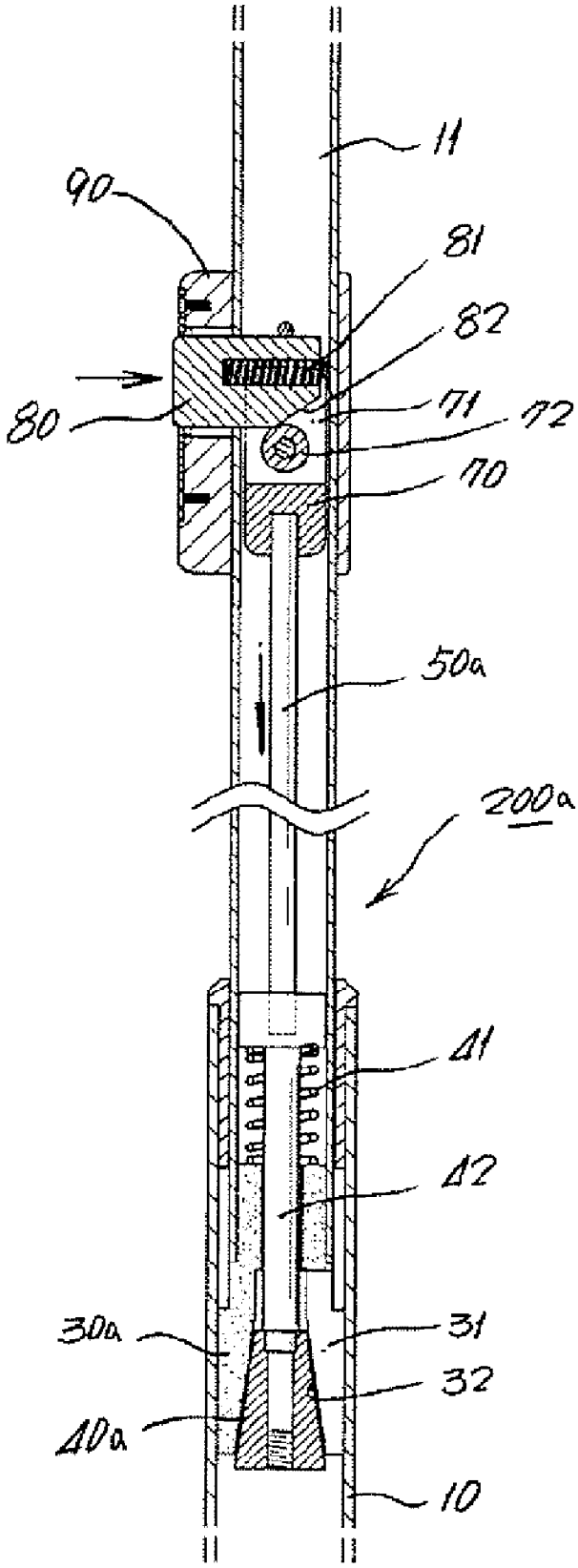

APPARATUS FOR REGULATING HEIGHT OF MUSIC RACK

TECHNICAL FIELD

The present invention relates to an apparatus for regulating a height of a music rack, and more particularly to an apparatus for regulating a height of a music rack capable of improving convenience and operability of a use by allowing a strut length of the music rack to be regulated conveniently and easily while simplifying its structure to improve manufacturability and assemblability.

BACKGROUND ART

In general, a performer, who plays various musical instruments, plays the instruments while seeing a score consisting of sheets having a predetermined size or a music book. It is generalized that such score is typically put and used on a music rack.

A variety of music racks are suggested and widely used. Among them, an example of music racks that are most widely used is shown in FIG. 1.

The music rack comprises a tripod-shaped support leg 1, which can be folded and rest easily on a ground, a strut 2 perpendicularly mounted to the support leg 1 and having a height capable of being regulated and a score bedplate 3 mounted to an upper end of the strut 2 and on which a score having a predetermined size is put.

In addition, since the strut 2 comprises pipes having sizes different from each other and mounted in a telescopic manner, its length can be changed. As shown in FIG. 2, a connection part of the pipes is fitted with a socket 4 to which a fixing knob 5 is screw-engaged, so that the strut can be fixed without a shake with its height being regulated.

Accordingly, when it is intended to regulate a height of the music rack, the fixing knob 5 is released and then the height of the strut 2 is changed in a telescopic manner. After that, the fixing knob 5 is again tightened, so that the height of the rack can be regulated.

However, the structure as described above has the problems that the fixing force is weak because the strut 5 can be fixed only with the tightening force of the fixing knob 5 and there can occur a scratch on a surface of the strut when the fixing knob 5 is strongly tightened.

In addition to the above problems, there are also other problems that an external appearance thereof is not good since the fixing knob 5 is protruded outwardly, and it is not possible to easily perform unfastening and tightening operations because the fixing knob 5 is small.

In the mean time, the applicant suggested a height regulating apparatus capable of regulating a height of a music rack just by pulling out or pushing a strut of the music rack with a physical force, so as to make up for the above problems.

The apparatus is suggested in a Korean Unexamined Utility Model Application No. 2003-22835 disclosing that a strut is comprised of pipe-shaped upper and lower members so that a length of the strut can be telescopically changed, the upper member is provided with a music bedplate, the lower member is provided with a tripod-shaped bedplate and fixing means for providing or releasing a fixing force by an elastic force of a spring is provided between the upper and lower members.

The fixing means comprises a fixing tube body that is engaged at a lower part of the upper member and thus widened to tightly contact to an inner diameter of the lower member or contracted, thereby providing or releasing the fixing force. The fixing tube body is provided with an operating body that is elastically mounted with a spring and thus contracts and expands the fixing tube body with physical rising and falling operations of a user.

Accordingly, it is possible to change a length of the strut just by pulling out or pushing in the upper and lower members of the strut using a physical force with the members being grasped by the user, so that the height of the music rack can be regulated conveniently and easily.

However, since the utility model disclosed has such a structure that the user should apply the elastic force of the spring with the physical force when regulating the length, it is needed much power, causing an inconvenience of a use. In addition, it is not easy to perform a minute regulation.

In addition, since the elastic force of the spring is gradually decreased when it is used for a long time, it is not possible to expect a smooth operation.

DISCLOSURE OF INVENTION

Technical Problem

Accordingly, the present invention has been made to solve the above-mentioned problems occurring in the prior art. An object of the present invention is to provide an apparatus for regulating a height of a music rack capable of improving convenience and operability of a use by allowing a height of the music rack to be regulated only with a simple manipulation while simplifying its structure to improve manufacturability and assemblability and to increase an aesthetic apprehension accompanying with an appearance.

Technical Solution

In order to achieve the above objects, there is provided an improved apparatus for regulating a height of a music rack. According to the invention, a strut is structured with pipe-shaped upper and lower members so that a length of the strut can be telescopically changed, fixing means for providing or releasing a fixing force by an elastic force of a spring is provided between the upper and lower members, and the fixing means is conveniently manipulated using a pedal mounted to a lower bedplate of a music rack, so that it is possible to regulate the height of the music rack conveniently and easily.

BRIEF DESCRIPTION OF THE DRAWINGS

The above and other objects, features and advantages of the present invention will be more apparent from the following detailed description taken in conjunction with the accompanying drawings, in which:

FIG. 1 a view showing a structure of a music rack according to the prior art;

FIG. 2 is a sectional view showing an essential part of FIG. 1;

FIG. 3 shows a general structure of a music rack applied with an embodiment of the invention;

FIG. 4 is a sectional plan view of FIG. 3 according to an embodiment of the invention;

FIG. 5 is a sectional view showing an essential pant of the invention;

FIG. 6 is a view showing a state that a braking force is released in FIG. 5;

FIG. 7 is an exploded perspective view showing an essential part of the invention;

FIG. 8 shows a music rack according to another embodiment of the invention;

FIG. 9 is a sectional view showing an essential pat of FIG. 8; and

FIG. 10 shows an operating state of FIG. 9.

MODE FOR THE INVENTION

Hereinafter, preferred embodiments of the present invention will be described with reference to the accompanying drawings. In the following description of the present invention, a detailed description of known functions and configurations incorporated herein will be omitted when it may make the subject matter of the present invention rather unclear.

FIGS. 3 to 7 show a general structure of the invention in detail. A main body of a music rack comprises a tripod-shaped bedplate 100, a strut 200 perpendicularly mounted to the bedplate 100 and having a length capable of being telescopically changed, and a score plate 300 mounted to an upper part of the strut 200.

The invention allows a height of the music rack to be arbitrarily regulated. That is, the strut 200 is formed into a pipe shape made of metal and assembled with a lower member 10 and an upper member 11 having diameters different from each other in a telescopic manner and a length of the strut is changed to regulate the height.

The lower member 10 has a lower end fixedly mounted to a center of the bedplate 100 perpendicularly and the upper member 11 is inserted and engaged with an inner diameter of the lower member 10, so that a length of the upper member is changed in a sliding manner. Inside of the members is mounted height regulating means for locking and unlocking the upper and lower members 10, 11.

The height regulating means comprises a support tube 20 fixedly mounted in the lower member 10 vertically, which tube 20 is formed into a pipe shape having a small inner diameter and has a lower end fixedly mounted to the center of the bedplate 100 with a fixing nut 21.

At this time, the fixing nut 21 provides a function of fixing the support tube 20 to the bedplate 100 integratedly and is formed with a perforated hole therein to provide a space in which a support rod, which will be described later, slides.

In addition, to an upper end of the support tube 20 is fixedly mounted a collet-shaped fixing tube body 30 which is tightly contacted to or separated from an inner diameter of the upper member 11 to provide or release a fixing force to and from the upper member.

The fixing tube body 30 is formed into a tube body shape and provided with a plurality of incised recesses 31 in an periphery of an upper part thereof so that it can contract and expand, and a slide recess 32 in an inner diameter thereof having a widened upper part and a lower part which is gradually narrowed.

Specifically, since the lower part of the fixing tube body 30 is fixed to the support tube 20 and the periphery of the upper part thereof is engaged to the inner diameter of the upper member 11, the tube body 30 provides a force for fixing the upper member 11 without a shake when it is widened outwardly, and releases the fixing force to allow the upper member 11 to slide when it is contracted inwardly.

In addition, an operating body 40 provides a function of widening outwardly or contracting inwardly the fixing tube body 30 by rise and fall operations, is mounted by a bolt 42 passing through the fixing tube body 30, formed into a cone type having a widened upper part and a lower part that is gradually narrowed, and also elastically mounted by a spring 41.

The operating body 40 has the structure opposing to the slide recess 32 of the fixing tube body 30 and is able to slide with being tightly engaged in the recess, thereby widening outwardly or contracting inwardly the fixing tube body 30.

In addition, the spring 41 fastened to the lower part of the bolt 42 operates the bolt 42 to be downwardly directed always with its elastic force, so that it directs the operating body 40 downwardly and thus applies a braking force.

Further, to the lower part of the operating body 40 is vertically mounted a support rod 50 for rising and falling the body, and a pedal 60 for rising and falling the bedplate 100 which is a lower end of the support rod 50 is mounted in the bedplate.

The support rod 50 is formed into an elongated rod shape. An upper end of the support rod is connected with a lower end of the bolt 42 of the operating body 40 in the support tube 20 and a lower end thereof passes through the fixing nut 21 to connect with the pedal, so that it rises and falls.

In addition, the pedal 60 is mounted to a bottom surface in the bedplate 100 and axial-connected with the bedplate 100 by a bracket 61 and a hinge shaft 62. An ejector plate 63 that is connected to a lower end of the support rod 50 to support the lower end is formed at a front end of the pedal and a footstool 64 is formed at a rear end thereof.

In other words, since the pedal 60 is axial-connected by the bracket 61 and the hinge shaft 62 which are fastened to the bottom surface of the bedplate 100, the pedal can be pivoted about the connected part as a fulcrum. Accordingly, when the pedal 64 is pushed down with a foot, the ejector plate 63 of the pedal is raised to push up the support rod 50.

The invention structured as described above has a simple structure as shown in Figs., so that it can be easily assembled. In addition, when the assembly is completed, related parts are hardly exposed to an exterior of the strut 200, so that it is possible to maintain a very simple structure.

As shown in FIG. 5, the operating body 40 is downwardly forced due to the elastic force of the spring 41. As a result of that, the cone-shaped operating body 40 is slid into the slide recess 32, so that it outwardly widens the fixing tube body 30 to apply the braking force, thereby maintaining the fixed state of the upper and lower members 10, 11 of the strut 200.

Under such state, when it is intended to regulate a length of the strut 200, i.e., a height of the music rack, as shown in FIG. 6, a user presses the pedal 50 to release the braking force and then can arbitrarily regulate the length of the strut 200.

Specifically, when the footstool 64 of the pedal 60 is pressed with a foot, the pedal 60 is pivoted about the hinge shaft 62 as a fulcrum, the ejector plate 63 at the front end thereof pushes up the support rod 50 that in turn raises the operating body 40 which was descended by the spring 41.

The operating body 40 is raised and thus escaped from the slide recess 32 of the fixing tube body 30, so that the fixing tube body 30 is contracted due to the plurality of incised recesses 31, thereby removing the braking force applying to the inner diameter of the upper member 11.

Accordingly, as described above, the braking force of the upper and lower members 10, 11 is removed, so that it is possible to change the length of the members in the telescopic manner without an additional high effort.

On the contrary, after the length of the strut 200 is regulated as described above, when the stepped pedal 60 is released, the operating body 40 is immediately descended to its original position due to the expanding force of the compressed spring 41 and the support rod 50 is also descended to return the pedal 60 into its original position at the same time.

At this time, the operating body 40, which is being returned, is tightly inserted into the slide recess 32 of the fixing tube body 30 to widen the fixing tube body 30 outwardly. As a result of that, the upper part of the fixing tube body 30 is outwardly widened to tightly contact to the inner diameter of the upper member 11, thereby applying the braking force.

Accordingly, it is possible to easily regulate the length of the strut 200 arbitrarily by pressing the pedal 60 to release the braking force, without an effort. On the contrary, if the stepped pedal 60 is released, the braking force is again applied, so that the regulated strut is fixed without a shake.

In the mean time, FIGS. 8 to 10 show another embodiment of the invention in detail. This embodiment comprises operating means mounted to the upper member of a strut 200*a*.

In this embodiment, as shown in Figs., related parts are mounted in a reverse direction in the strut 200*a* and operating means for locking and unlocking the parts is mounted to an upper part of the strut so that it can be operated with a hand.

The music rack comprises a tripod-shaped bedplate 100*a*, a telescopic strut 200*a* and a score plate 300*a* mounted to an upper part of the strut 200*a* and on which a score can be put.

The strut 200*a* comprises a lower member 10 fixedly mounted to the bedplate 100*a* perpendicularly and an upper member 11 engaged in the lower member 10 in a telescopic manner and allowing its length to be changed. To a lower end of the upper member 11 is fixedly mounted a collet-shaped fixing tube body 30*a* having a periphery tightly contacted to or separated from an inner diameter of the lower member 10 to provide or release a fixing force to and from the lower member.

In other words, the fixing tube body 30*a* is formed into a tube body shape and comprises one end fixedly mounted to an end of the upper member 11, a periphery closely engaged to the lower member 10 and provided with a plurality of incised recesses 31 to allow it to contract and expand, and an inner diameter having a slide recess 32 with a tapered surface.

Accordingly, when the fixing tube body 30*a* is outwardly widened, the inner diameter of the lower member 10 contacts to it tightly, thereby providing a fixing force. On the contrary, when the fixing tube body is inwardly contracted, the fixing force is released, so that the upper member 11 can slide.

In addition, to the fixing tube body 30*a* is elastically mounted an operating body 40*a* for widening outwardly or contracting inwardly the fixing tube body 30*a*.

The operating body 40*a* is tightly engaged in the slide recess 32 by the bolt 42 passing through the fixing tube body 30*a* and the spring 41 is engaged to the upper part of the bolt 42. The spring 41 has a cone shape whose lower part is wide and which is gradually narrowed toward the upper part thereof. Accordingly, the spring widens the fixing tube body outwardly or contracts it by a rising and falling action.

At this times the spring 41 always forces the bolt 42 upwardly by its elastic force, so that it forces the operating body 40*a* upwardly at ordinary times and thus applies the, braking force.

In addition, a support rod 50*a* for rising and falling the operating body 40*a* is vertically mounted to the upper part of the operating body 40*a* and connected with operating means mounted to a predetermined position of the upper member 11 which is an upper end of the support rod 50*a*

The operating means comprises a pushing body 70 fixed to an end of the support rod 50*a* and going up and down along the inner diameter of the upper member 11, an operating lever 80 horizontally mounted to the upper member 11 and rising and falling the pushing body 70 and a holder 90 for fixing the operating lever 80 to the upper member 11.

The pushing body 70 is formed into a cylindrical shape and comprises an engaging recess 71 to which the operating lever 80 is vertically engaged and an idling 72 is axial-connected, and a lower end fixedly mounted to the upper end of the support rod 50*a*.

In addition, the operating lever 80 is horizontally and elastically mounted by a spring 81 through the upper member 11 and the engaging recess 71 of the pushing body 70 and comprises a tapered surface 82 provided at a lower part of the front end thereof and abutting on the idling 72 of the pushing body 70.

Additionally, the operating lever 80 is mounted to the upper member 11 by the holder 90 that is engaged at a periphery of the upper member 11 and guides advancing and retreating movements of the operating body 80.

According to the music rack structured as described above, it is possible to easily release the braking force by operations of the operating means mounted to the upper member 11 of the strut 100*a*, thereby change the length thereof arbitrarily.

Specifically, when the operating lever 80 is pushed, the operating lever 80 compresses the spring 81 and horizontally advances at the same time as shown in FIG. 10. Thereby, the tapered surface 82 thereof presses the idling 72 of the pushing body 70 downwardly, so that the pushing body 70 and the support rod 50*a* are descended simultaneously.

As the support rod 50*a* *is* descended, the operating body 40*a* is escaped from the slide recess 32 of the fixing tube body 30a, so that the fixing tube body 30*a* is contacted to release the braking force.

Accordingly, it is possible to arbitrarily operate the upper and lower members 10, 11 to regulate the length thereof. In addition, under state that the length is regulated, when the pressed pushing lever 80 is released, the braking force is immediately applied, so that the length of the strut 200*a* is fixed with it being regulated, In other words, as shown in FIG. 9, the operating body 40*a* is completely returned into the slide recess 32 of the fixing tube body 30*a* by the restoring force of the compressed spring 41, so that the fixing tube body 30*a* is widened outwardly and the periphery thereof is thus tightly contacted to the inner diameter of the lower member 10, thereby providing the fixing force.

At the same time, as the operating body 40*a* is ascended, the support rod 50*a* is also ascended to its original position and the operating lever 80 is returned into its original position by the elastic force of the spring 81 and the ascending force of the support rod 50*a*, so that they stand ready for a next operation.

Accordingly, according to the above embodiment, since the operating means is situated at the upper part of the strut, it is possible to grasp the strut with a hand and at the same time to push the operating lever. As a result of that, it is possible to arbitrarily regulate the length of the music rack in a one-touch manner.

In the mean time, the invention as described above can be applied to other articles having a length capable of being regulated in a telescopic manner as well as the music rack, although they are not specifically shown in Figs.

For example, the invention can be applied to various medical assist devices such as a ringer stand, including a speaker stand, a mike stand, a stand advertising board, a national flag stand, a school experiment device stand, a hanger used in a laundry and a cloth stand for displaying various clothes.

While the invention has been shown and described with reference to certain preferred embodiments thereof, it will be understood by those skilled in the art that various changes in form and details may be made therein without departing from the spirit and scope of the invention as defined by the appended claims.

The invention claimed is:

1. An apparatus for regulating a height of a music rack wherein the rack comprises a strut having upper and lower members vertically mounted to a bedplate in a telescopic manner and a length capable of being regulated, and a score plate mounted to an upper part of the strut, the apparatus comprising:

a support tube fixedly mounted in the lower member of the strut vertically;

a fixing tube body engaged to an upper end of the support tube and provided with a plurality of incised recesses in an periphery of an upper part thereof and a slide recess in an inner diameter thereof having a widened upper part and a lower part which is gradually narrowed;

an operating body tightly engaged in the slide recess of the fixing tube body and elastically mounted by a bolt passing through the operating body and a spring;

a support rod mounted vertically in the support tube and engaged at an upper end thereof to a lower part of the operating body by engagement with a lower end of the bolt; and a pedal mounted to the bedplate and configured to engage the support rod to raise and lower the support rod through a pushing operation.

2. The apparatus according to claim 1, wherein the support tube is vertically mounted in the lower member and a lower part thereof is fixedly mounted to the bedplate by a fixing nut.

3. The apparatus according to claim 1, wherein the pedal is axial-connected with the bedplate by a bracket and a hinge shaft, and comprises an ejector plate formed at a front end of the pedal and supporting a lower part of the support rod and a footstool formed at a rear end of the pedal and capable of being pushed by a foot.

4. An apparatus for regulating a height of a music rack wherein the rack comprises a strut having upper and lower members vertically mounted to a bedplate in a telescopic manner and a length capable of being regulated, and a score plate mounted to an upper part of the strut, the apparatus comprising:

a fixing tube body fixedly engaged to a lower end of the upper member of the strut and provided with a plurality of incised recesses in an periphery of an upper part thereof and a slide recess in an inner diameter thereof having a widened upper part and a lower part which is gradually narrowed;

an operating body tightly engaged in the slide recess of the fixing tube body and elastically mounted by a bolt passing through the operating body and a spring;

a support rod mounted vertically in the upper member and engaged at a lower end thereof to an upper part of the operating body by engagement with an upper end of the bolt;

a pushing body fixed to an upper end of the support rod, and configured to rise and fall in the upper member and having an incised engaging recess at an upper part thereof and an idling axial-connected therein; and an operating member horizontally movable in the upper member to advance and retreat and having a tapered surface at a front end thereof configured to push the pushing body.

5. The apparatus according to claim 4, wherein the operating lever is horizontally mounted by a holder through the upper member and the engaging recess of the pushing body, a spring is mounted to a front end of the lever and the tapered surface abutting on the idling of the pushing body is provided to a lower part of the front end.

* * * * *